US010316379B2

(12) United States Patent
Gross et al.

(10) Patent No.: US 10,316,379 B2
(45) Date of Patent: Jun. 11, 2019

(54) HIGH TEMPERATURE STEEL FOR STEAM TURBINE AND OTHER APPLICATIONS

(71) Applicant: Northwestern University, Evanston, IL (US)

(72) Inventors: Cameron T. Gross, Evanston, IL (US); Yao Du, Evanston, IL (US); Xu Zhang, Evanston, IL (US); Dieter Isheim, Chicago, IL (US); Semyon Vaynman, Highland Park, IL (US); Yip-Wah Chung, Wilmette, IL (US); Zilin Jiang, Evanston, IL (US); Allan V. Mathai, Evanston, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 165 days.

(21) Appl. No.: 15/296,549

(22) Filed: Oct. 18, 2016

(65) Prior Publication Data

US 2017/0121782 A1 May 4, 2017

Related U.S. Application Data

(60) Provisional application No. 62/248,746, filed on Oct. 30, 2015.

(51) Int. Cl.

| | |
|---|---|
| ***C22C 38/02*** | (2006.01) |
| ***C21D 6/00*** | (2006.01) |
| ***C21D 1/28*** | (2006.01) |
| ***C22C 38/04*** | (2006.01) |
| ***C22C 38/22*** | (2006.01) |
| ***C22C 38/24*** | (2006.01) |
| ***C22C 38/26*** | (2006.01) |

(52) U.S. Cl.

CPC ..... *C21D 6/002* (2013.01); *C21D 1/28* (2013.01); *C22C 38/02* (2013.01); *C22C 38/04* (2013.01); *C22C 38/22* (2013.01); *C22C 38/24* (2013.01); *C22C 38/26* (2013.01)

(58) Field of Classification Search

CPC ..... C22C 38/26; C22C 38/02; C22C 38/04; C22C 38/22; C22C 38/24; C21D 6/002; C21D 1/28

See application file for complete search history.

(56) References Cited

U.S. PATENT DOCUMENTS

| | | | |
|---|---|---|---|
| 3,663,208 | A | 5/1972 | Kirby et al. |
| 4,405,369 | A | 9/1983 | Otoguro et al. |
| 6,514,359 | B2 | 2/2003 | Kawano |
| 8,317,944 | B1 | 11/2012 | Jablonski et al. |
| 2008/0035296 | A1 | 2/2008 | Nakamyo |

FOREIGN PATENT DOCUMENTS

| | | | | |
|---|---|---|---|---|
| CN | 100434542 | | 11/2008 | |
| EP | 0219089 | | 4/1987 | |
| EP | 1544312 | | 6/2005 | |
| EP | 2 042 615 | * | 4/2009 | ..... C21D 9/46 |
| JP | 2004-300516 | * | 10/2004 | ..... C22C 38/26 |
| JP | 2009-091654 | * | 4/2009 | ..... C22C 38/54 |
| WO | WO2005095662 | | 10/2005 | |

OTHER PUBLICATIONS

English Abstract and English Machine Translation of Yano (JP 2009-091654) (Apr. 30, 2009).*

English Abstract and English Machine Translation of Takano et al. (JP 2004-300516) (Oct. 28, 2004).*

International Search Report and Written Opinion mailed in PCT Patent Application No. PCT/US2016/057492, dated Dec. 19, 2016.

Gross et al., Designing high-temperature steels via surface science and thermodynamics, Surface Science 648, Oct. 19, 2015, pp. 196-200.

* cited by examiner

*Primary Examiner* — Jessee R Roe

(74) *Attorney, Agent, or Firm* — Bell & Manning, LLC

(57) ABSTRACT

Steel compositions are provided. A steel composition may include iron; from 0.015 to 0.06 wt. % carbon; from 9 to 12 wt. % chromium; from 0.75 to 1.5 wt. % manganese; from 0.08 to 0.18 wt. % molybdenum; from 0.10 to 0.30 wt. % silicon; from 0.2 to 1.0 wt. % vanadium; from 0.05 to 1.2 wt. % niobium; and optionally, an amount of an additional precipitate forming alloying element. Methods of making the steel compositions are also provided.

17 Claims, 15 Drawing Sheets

Incoherent

Semi-coherent

Coherent

HIGH TEMPERATURE STEEL FOR STEAM TURBINE AND OTHER APPLICATIONS

CROSS-REFERENCE TO RELATED APPLICATIONS

This application claims priority from U.S. provisional patent application Ser. No. 62/248,746, filed on Oct. 30, 2015, which is hereby incorporated by reference in its entirety.

REFERENCE TO GOVERNMENT RIGHTS

This invention was made with government support under CMMI-1130000 and CMMI-1462850 awarded by the National Science Foundation. The government has certain rights in the invention.

BACKGROUND

In the US, about 67% of the generated electricity is produced by burning fossil fuels, of which coal contributes about 39% (U.S. Energy Information Administration, May 2015 Monthly Energy Review, Washington, D.C., 2015 102). The corresponding numbers for China are 69% and 63% (U.S. Energy Information Administration, China International energy data and Analysis, Washington, D.C., 2015). Burning of coal not only emits more carbon dioxide per kWh electricity produced compared with natural gas (U.S. Energy Information Administration, http://www.eia.gov/tools/faqs/faq.cfm?id=74&t=112015), but also particulates and other toxic pollutants such as mercury and arsenic (U.S. Environmental Protection Agency, http://www.epa.gov/cleanenergy/energyand-you/affect/air-emissions.htm12014). Since it is unlikely for the US, China and other countries to stop burning fossil fuels to produce electricity in the foreseeable future, the most reasonable solution to mitigate $CO_2$ and pollutant emission is to make power plants more efficient. US coal-fired power plants operate at an average efficiency of 32%, emitting about 1000 gm $CO_2$ per kWh electricity produced. According to the World Coal Association, if one can raise the efficiency to 50%, the $CO_2$ emission will be reduced to about 700 gm per kWh (World Coal Association, http://www.worldcoal.org/extract/cleaner-coal-technologiesvital-to-reducing-global-co2-emissions-5096/2015).

One can increase the thermal efficiency of these power plants by operating the steam generator at higher temperatures (and pressures). Most steam turbines in the US operate at 540° C. or below, and the proposed target by the US Department of Energy is to increase the operating temperature to 760° C. Extensive research studies are being conducted on the use of Ni-based superalloys for such applications, and results are quite promising (A. F. Stam, Proceedings from the Seventh International Conference on Advances in Materials Technology for Fossil Power Plants 2013, p. 74). However, a drawback of these superalloys is their cost, about $30-40/kg in 2015.

SUMMARY

Provided are steel compositions and methods of forming the steel compositions.

In one aspect, steel compositions are provided. In embodiments, a steel composition includes iron; from 0.015 to 0.06 wt. % carbon; from 9 to 12 wt. % chromium; from 0.75 to 1.5 wt. % manganese; from 0.08 to 0.18 wt. % molybdenum; from 0.10 to 0.30 wt. % silicon; from 0.2 to 1.0 wt. % vanadium; from 0.05 to 1.2 wt. % niobium; and optionally, an amount of an additional precipitate forming alloying element.

In another aspect, methods of forming steel compositions are provided. In embodiments, a method of making a steel composition includes forming an ingot including iron; from 0.015 to 0.06 wt. % carbon; from 9 to 12 wt. % chromium; from 0.75 to 1.5 wt. % manganese; from 0.08 to 0.18 wt. % molybdenum; from 0.10 to 0.30 wt. % silicon; from 0.2 to 1.0 wt. % vanadium; from 0.05 to 1.2 wt. % niobium; and optionally, an amount of an additional precipitate forming alloying element; normalizing the ingot; and cooling the normalized ingot.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DESCRIPTION

Figure 1C:
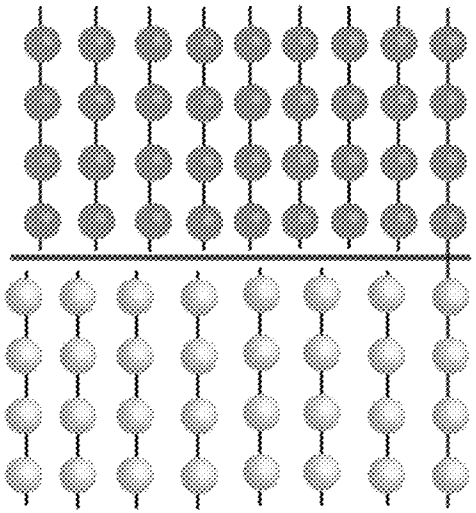
FIGS. 1A-1C depict schematic illustrations of different interface types including coherent (FIG. 1A), semi-coherent (FIG. 1B), and incoherent (FIG. 1C).

Provided are steel compositions and methods of forming the steel compositions.

The present steel compositions are based on plain carbon steel containing iron (Fe), carbon (C), silicon (Si) and manganese (Mn); the alloying elements chromium (Cr), molybdenum (Mo), vanadium (V), niobium (Nb); and optionally, an additional precipitate forming alloying element, e.g., zirconium (Zr). It has been found that including these elements in particular relative amounts provides steel compositions which exhibit excellent mechanical properties (e.g., Vickers Hardness of greater than about 20 kg/mm$^2$) even after exposure to high temperatures (e.g., about 700° C.) for long times (e.g., about 1000 h). Moreover, these properties are achieved even using minimal amounts of expensive Mo (e.g., 0.18 weight % or less) and even in the absence of other alloying elements such as nickel (Ni). It has also been found that steel compositions exhibiting these properties can be formed without using any additional thermomechanical processing steps after normalizing, simplifying manufacturing and further reducing costs.

The present steel compositions may be used in any applications requiring high strength steel in which the steel is exposed to high temperatures for long periods of time, e.g., turbines, tubing, piping, etc., used in supercritical and ultra-supercritical steam driven power plants, oil pipelines, and chemical processing plants. Because at least some embodiments of the steel compositions exhibit superior strength under such conditions, they are capable of increasing the efficiency of steam-driven power plants and thus, achieving massive reductions in $CO_2$ emissions.

In one aspect, steel compositions are provided. The present steel compositions contain C, Cr, Mn, Mo, Si, V, Nb, and optionally, an additional precipitate forming alloying element, e.g., Zr. Impurities such as phosphorous (P) and sulfur (S) may be present in the steel compositions although their amounts are desirably minimized. The balance of the steel compositions is iron (Fe). The steel compositions may also be referred to as "low-carbon ferritic stainless steel compositions."

The amount of carbon in the present steel compositions may be in the range of from 0.015 to 0.06 weight (wt.) %. Throughout this disclosure "wt. %" refers to the (weight of a particular component)/(total weight of the steel composition)*100. In embodiments, the amount of carbon is in the range of from 0.020 to 0.038 wt. %, from 0.023 to 0.035 wt. %, or from 0.026 to 0.032 wt. %. Carbon will form precipitates in the steel compositions, e.g., MC, wherein M is a transition metal, e.g., V, Nb, Mo, which improves strength. However, these amounts of carbon serve to limit the $M_{23}C_6$ mole fraction and maintain weldability.

The amount of chromium in the present steel compositions may be in the range of from 9 to 12 wt. %. In embodiments, the amount of chromium is in the range of from 9 to 11 wt. %. Chromium serves to provide corrosion protection.

The amount of manganese in the present steel compositions may be in the range of from 0.75 to 1.5 wt. %. In embodiments, the amount of manganese is in the range of from 0.76 to 1.42 wt. %, from 0.87 to 1.31 wt. %, or from 0.98 to 1.20 wt. %. Manganese acts as a scavenger to residual sulfur.

The amount of molybdenum in the present steel compositions may be in the range of from 0.08 to 0.18 wt. %. In embodiments, the amount of molybdenum is in the range of from 0.08 to 0.16 wt. %, from 0.10 to 0.14 wt. %, or from 0.11 to 0.13 wt. %. Molybdenum serves to slow the coarsening rate of MC precipitates in the steel composition, thereby improving strength. These amounts of molybdenum are significantly less than in many conventional steel compositions. Nevertheless, embodiments of the present steel compositions have been found to exhibit improved strength after exposure to high temperatures for long times as compared to such conventional steel compositions. Moreover, limiting the amount of expensive molybdenum reduces cost.

The amount of silicon in the present steel compositions may be in the range of from 0.10 to 0.30 wt. %. In embodiments, the amount of silicon is in the range of from 0.15 to 0.27 wt. %, from 0.17 to 0.25 wt. %, or from 0.19 to 0.23 wt. %. Silicon is a deoxidizer.

Figure 1B:
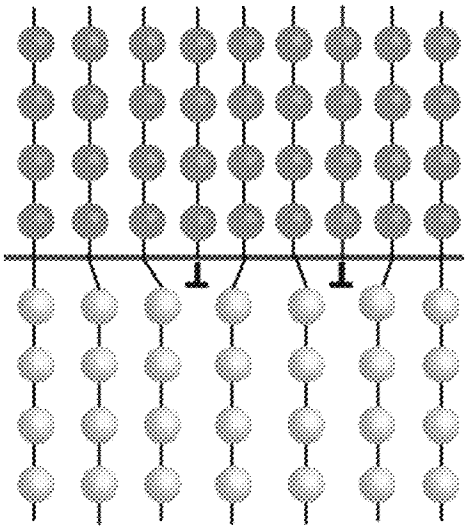

The present steel compositions contain the precipitate forming alloying elements vanadium and niobium. As described in the Examples, below, vanadium and niobium are slow diffusing elements which form monocarbide precipitates, i.e., VC and NbC precipitates, respectively. As illustrated in FIG. 1B, these precipitates form a semi-coherent interface with the surrounding bcc iron matrix, which exerts a drag on moving dislocations within the matrix. This reduces the mobility of the dislocation and maintains the strength of the steel composition even at high temperatures, e.g., greater than about 600° C.

The amount of vanadium in the steel compositions may be in the range of from 0.2 to 1.0 wt. %. In embodiments, the amount of vanadium is in the range of from 0.2 to 0.4 wt. %, or from 0.3 to 1.0 wt. %, or from 0.8 to 1.0 wt. %. The amount of niobium in the steel compositions may be in the range of from 0.05 to 1.2 wt. %. In embodiments, the amount of niobium is in the range of from 0.04 to 0.08 wt. %, or from 0.05 to 0.07 wt. %, or from 0.06 to 0.07 wt. %. These amounts have been found to maximize the phase fraction of MC while minimizing the amount of less desirable phases such as $M_{23}C_6$, intermetallics, etc., even at high temperatures, e.g., greater than about 600° C.

The present steel compositions may contain an additional precipitate forming alloying element. This additional precipitate forming alloying element may be an element which has chemical properties that facilitate the formation of core-shell precipitates. By "core-shell precipitate" it is meant a precipitate having a core containing one type of transition metal and a shell formed over the core, the shell containing a different type of transition metal. By way of illustration, the core-shell precipitate may be composed of a core containing a first transition metal $M_a$ and a shell containing a second transition metal $M_b$, wherein $M_a$ is a transition metal selected to facilitate core-shell precipitate formation and $M_b$ is vanadium, niobium or molybdenum. In the core and shell, the transition metals $M_a$ and $M_b$ may be in the form of a monocarbide, i.e., $M_aC$ and $M_bC$. The chemical properties that facilitate core-shell precipitate formation include the diffusivity, the enthalpy of monocarbide (MC) formation and the interfacial energy with the bcc iron matrix of the additional precipitate forming alloying element relative to other precipitate forming alloying elements in the steel composition (e.g., V, Nb, Mo). To facilitate core-shell precipitate formation, the additional precipitate forming alloying element has a slower diffusivity, a larger negative enthalpy of MC formation, and larger interfacial energy with the bcc iron matrix when compared to the other precipitate forming alloying elements in the steel composition. When these conditions are satisfied, the additional precipitate forming alloying element can form the core first and stably act as the nucleation sites for the shell carbides.

A suitable additional precipitate forming alloying element is zirconium. By way of illustration, by using zirconium, core-shell precipitates may form having a core of ZrC and a shell of VC. The core-shell structure means that zirconium must diffuse through the VC outer shell, thereby further reducing precipitate coarsening and improving strength at high temperatures, e.g., greater than about 600° C. Another additional precipitate forming alloying element is hafnium (Hf).

The additional precipitate forming alloying element may be present in an amount to maximize the phase fraction of MC while minimizing the amount of less desirable phases as described above. The amount may also be selected to facilitate the formation of core-shell precipitates. When the additional precipitate forming alloying element is zirconium, the zirconium may be present in an amount of at least 0.06 wt. %. This includes embodiments in which the amount is at least 0.1 wt. % or at least 0.15 wt. %. This further includes embodiments in which the amount is in the range of from 0.06 to 0.3 wt. %, from 0.1 to 0.3 wt. %, from 0.15 to 0.27 wt. %, from 0.17 to 0.25 wt. %, or from 0.19 to 0.23 wt. %. When the additional precipitate forming alloying element is hafnium, the hafnium may be present in an amount in the range of from 0.12 to 0.40 wt. %, from 0.13 to 0.36 wt. %, from 0.14 to 0.32 wt. %, or from 0.16 to 0.28 wt. %.

Steel compositions containing C, Cr, Mn, Mo, Si, V, Nb, and optionally, the additional precipitate forming alloying element, where these elements are present in various combinations of the amounts described above may be used. As noted above, such steel compositions may contain impurities typically associated with steel (e.g., P, S) and will contain a balance of Fe. In embodiments, the steel compositions consist essentially of Fe, C, Cr, Mn, Mo, Si, V, Nb, and optionally, the additional precipitate forming alloying element. The phrase "consist essentially of" is meant to recognize that such steel compositions may contain impurities typically associated with steel. Again, the amounts of the elements in such embodiments may be selected from any of those described above, in any combination.

In embodiments, the present steel compositions are free of a variety of other elements used in conventional steel compositions. Such elements include one or more of the following: aluminum (Al), nickel (Ni), tungsten (W), nitrogen (N), boron (B), calcium (Ca), titanium (Ti), yttrium (Y), lanthanum (La), cerium (Ce), tantalum (Ta), copper (Cu), cobalt (Co), magnesium (Mg), neodymium (Nd), and any other of the rare earth elements.

The precipitates of the present steel compositions may be characterized by their shape, size, and distribution throughout the steel composition. These properties may be measured using the technique of atom probe tomography (APT) as described in the Examples, below. These properties may be measured and their values reported with respect to certain environmental conditions. By way of illustration, steel compositions which have not been subjected to any aging may be evaluated and their properties measured as well as steel compositions subjected to various aging conditions (e.g., subjected to a particular temperature (e.g., 600° C. or 700° C.) for a particular time (e.g., 10 h, 100 h, 1000 h)). The precipitates may be substantially spherical in shape, by which it is meant that the shape is spherical although not necessarily perfectly spherical. The precipitates may have a diameter which is about 20 nm or less, about 10 nm or less, about 5 nm or less, or in the range of from about 1 nm to about 20 nm. The diameter may be an average diameter, by which it is meant an average value over a population of precipitates. The precipitates may be distributed substantially uniformly throughout the steel composition.

Core-shell precipitates may exhibit similar shapes, sizes and distribution as described above. However, the diameter of the core may vary with different atomic percentage ratios of the additional precipitate forming alloying element (e.g., Zr) versus other precipitate forming alloying elements (V, Nb). In embodiments, the core composes between about 20% and about 80% of the total volume of the core-shell precipitate.

The present steel compositions may be characterized by their mechanical properties, e.g., Vickers Hardness (VH). The VH may be measured using the technique and conditions described in the Examples, below (e.g., at a temperature of 700° C.). The VH may be measured and reported for steel compositions which have not been subjected to any aging as well as steel compositions subjected to various aging conditions (e.g., subjected to a particular temperature (e.g., 600° C. or 700° C.) for a particular time (e.g., 10 h, 100 h, 1000 h)). In embodiments, the steel composition exhibits a VH at 700° C. of at least about 30 kg/mm$^2$, at least about 35 kg/mm$^2$, at least about 40 kg/mm$^2$, or at least about 45 kg/mm$^2$ after aging at 700° C. for 10 h. In embodiments, the steel composition exhibits a VH at 700° C. of at least about 20 kg/mm$^2$, at least about 25 kg/mm$^2$, at least about 30 kg/mm$^2$, or at least about 35 kg/mm$^2$ after aging at 700° C. for 1000 h.

In another aspect, methods of making the present steel compositions are provided. The methods include forming (e.g., via vacuum arc melting) an ingot containing each element in the selected amount, normalizing the ingot for a temperature (e.g., from about 950° C. to about 1100° C.) and time (e.g., about 1 h), and cooling the normalized ingot. The cooling step may be accomplished, e.g., by air-cooling or water quenching. By contrast to conventional methods of forming steel, the present methods do not require or include any thermomechanical processing step(s) (e.g., tempering) beyond normalizing. Thus, the cooling step may be carried out immediately after the normalizing step. This greatly simplifies the manufacturing process and reduces costs.

As described above, the present steel compositions may be used in a variety of applications, e.g., steam driven power plants, oil pipelines, and chemical processing plants. Thus, turbines, pipes, tubing, etc. containing any of the steel compositions are also provided.

EXAMPLES

Example 1

In this Example, thermally stable precipitates are used for increasing the strength of structural steel.

Precipitate Structure

In the early stage of precipitate growth and assuming interfacial kinetics controlled growth, the growth velocity v of a precipitate due to arrival of solute atoms from the matrix to the precipitate surface is given by Equation 1:

$$v \propto \exp(-\Delta f_m/kT)[1-\exp(-\Delta f_{mp}/kT)] \quad (1)$$

where $\Delta f_m$ is the activation energy for the migration of the solute atom from the matrix to the precipitate, $\Delta f_{mp}$ is the free energy difference between the solute atom in the matrix and precipitate, k is the Boltzmann constant, and T is temperature. $\Delta f_{mp}$ contains an interfacial energy term; the sign of $\Delta f_{mp}$ is such that a coherent matrix-precipitate interface makes $\Delta f_{mp}$ more positive, resulting in a higher growth rate. Just nucleated precipitates should be coherent with the matrix. Upon further aging, precipitates coarsen through an Ostwald ripening process, i.e., larger precipitates growing at the expense of smaller ones. This process is described well by the LSW equation (Equation 2):

$$R(t)^3 - R_o^3 \gamma D(t - t_o) \quad (2)$$

where R(t) is the precipitate radius at time t, $R_o$ is the precipitate radius at $t_o$, D is the diffusivity of the solute atom, and γ is the interfacial free energy. Coherent precipitates with low interfacial free energy and made of slow diffusing elements will grow slower than incoherent ones.

Figure 1A:
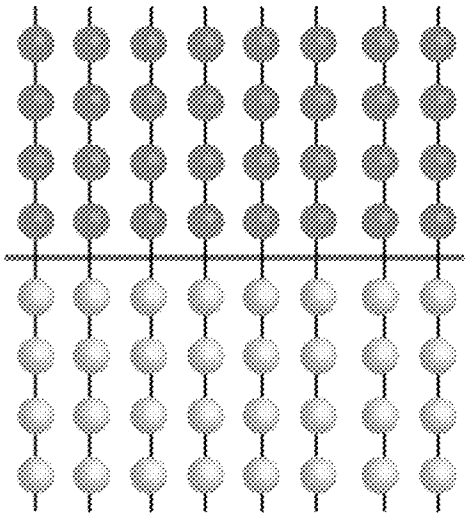

This Example makes use of MC precipitates which are transition metal monocarbides with the B1 (NaCl) structure, including VC and NbC. Lattice constants of VC and NbC are 0.417 nm (E. K. Storms, C. P. Kempter, J. Chem. Phys. 42 (1965) 2043) and 0.447 nm (E. K. Storms, N. H. Krikorian, J. Chem. Phys. 63 (1959) 1747, C. P. Kempter, E. K. Storms, J. Less-Common Met. 13 (2003) 443), respectively. These carbide precipitates will form with a Baker-Nutting orientation on the bcc iron lattice (H. Kestenbach, E. V. Morales, Acta Microsc. 7 (1998) 22, Z. Yang, M. Enomoto, Mater. Sci. Eng. A 332 (2002) 184). The length of the unit vector along the [110] direction of bcc Fe is $0.287 \times 2^{1/2} = 0.406$ nm. Therefore, on the (001) plane, MC is coherent with Fe (45° rotation) with lattice mismatch of 2.7% for VC and 10.1% for NbC. Along the [010] direction, MC is commensurate with Fe (two unit cells of MC matching three unit cells of Fe) with lattice mismatch of 3.3% for VC and 10.1% for NbC. Therefore, in order for the MC precipitate to form coherent interfaces with the Fe matrix to achieve low interfacial energy, the system has to pay a strain energy penalty. Minimization of the total free energy results in the MC precipitate forming a coherent or semi-coherent interface, as illustrated in FIGS. 1A-1C.

The semi-coherent interface formed between MC precipitates and the Fe matrix is not necessarily a disadvantage. At elevated temperatures, precipitates become less effective obstacles against dislocation climb due to thermal activation. However, a semi-coherent precipitate-matrix interface has an attractive interaction with an impinging dislocation. In particular, as such a dislocation sweeps over the surface of a spherical precipitate, the attractive interaction by the semi-coherent precipitate-matrix interface exerts a drag on the dislocation, reducing its mobility and maintaining the alloy strength even at elevated temperatures.

Computational Thermodynamics Modeling

Figure 2A:
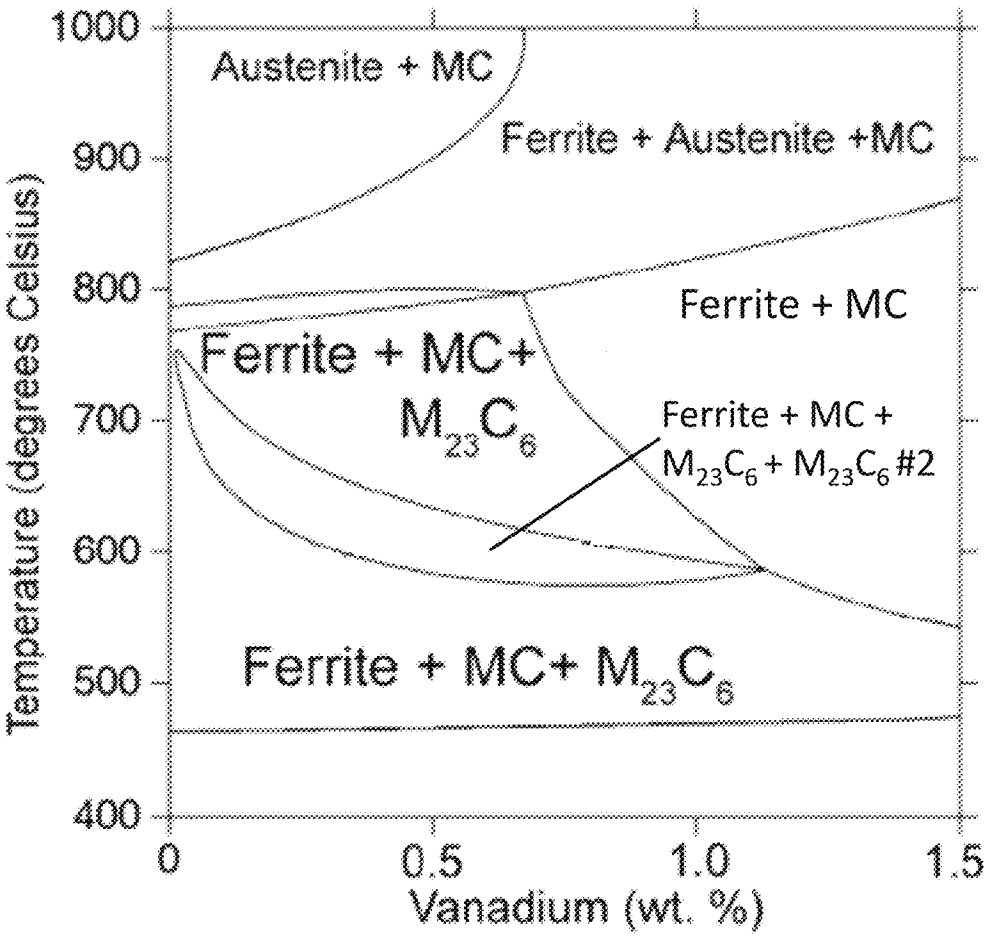
FIG. 2A plots the calculated vanadium (V) isopleths of a low-carbon steel composition containing 10 wt. % Cr and variable amounts of V.
Figure 2B:
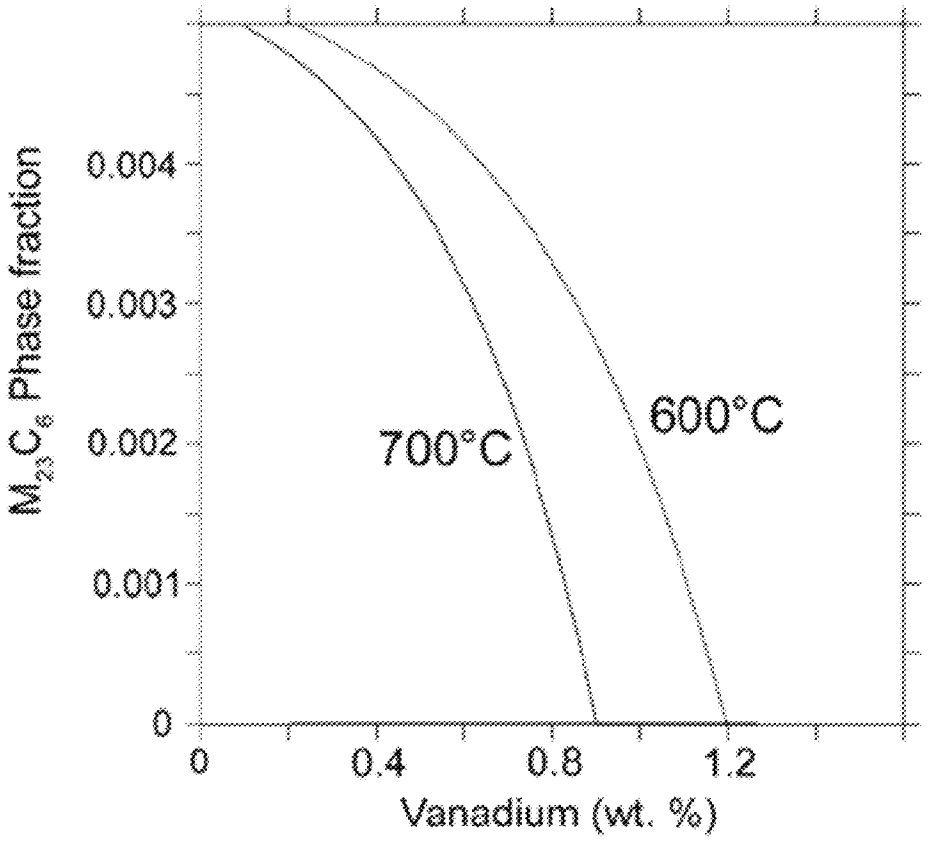
FIG. 2B plots the $M_{23}C_6$ phase fraction at 600° C. and 700° C. versus V concentration for the low-carbon steel composition of FIG. 2A.
Figure 2C:
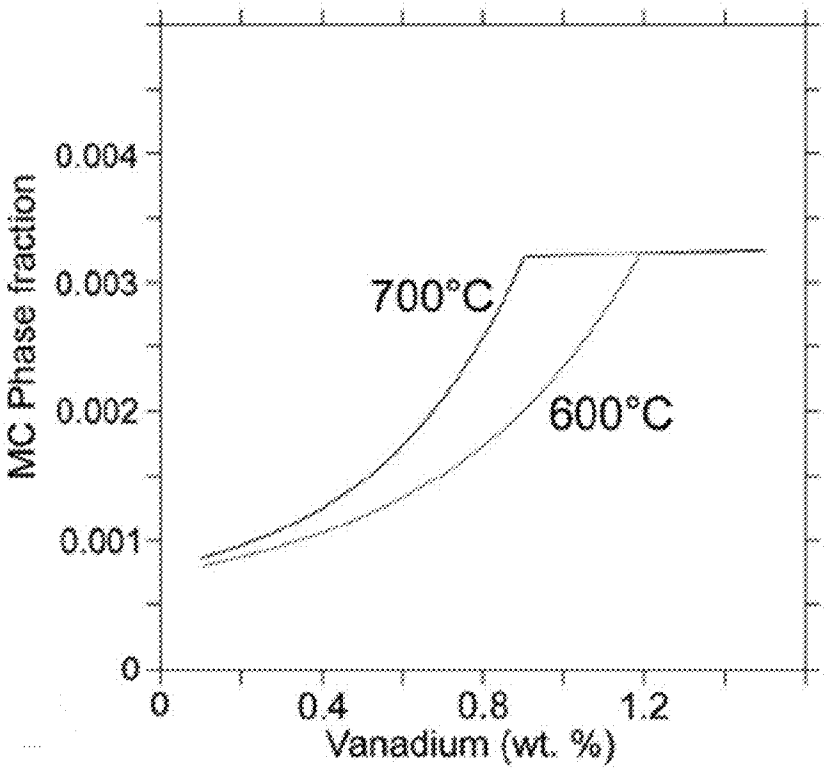
FIG. 2C plots the MC phase fraction at 600° C. and 700° C. versus V concentration for the low-carbon steel composition of FIG. 2A.

This Example makes use of plain carbon steel containing Fe, C, Si, and Mn. Four additional alloying elements were considered: Cr for corrosion protection, Mo for slower diffusion, Nb and V for the formation of MC precipitates as described above. Computational thermodynamics was used to evaluate to the phase fraction of MC as a function of steel composition, especially at elevated temperatures. Commercial software (Thermo-Calc) was used with the SGTE Solutions Database version 2.1 (SSOL2). The Scientific Group Thermodata Europe developed the SGTE/SSOL2 database. An example of one such computation for a low-carbon steel is illustrated in FIG. 2A. This figure shows a vanadium isopleth for a steel composition containing 10Cr-xV (in wt. %). The steel otherwise had the composition of Tables 1B, 1C, i.e., containing 0.029 wt. % C, 10.0 wt. % Cr, 1.09 wt. % Mn, 0.12 wt. % Mo, 0.06 wt. % Nb and 0.21 wt. % Si. When the V concentration is greater than or equal to 1.0 wt. %, MC is the only stable precipitate phase between 600 and 800° C. More importantly, the equilibrium concentration of complex carbide $M_{23}C_6$ steadily decreases with increasing V concentration, while the MC phase fraction increases, as shown in FIGS. 2B and 2C. At sufficiently high V concentration, the $M_{23}C_6$ carbide phase disappears above a certain temperature. $M_{23}C_6$ is undesirable because it is not stable against coarsening at elevated temperatures.

FIG. 2A also shows that over the range of vanadium composition shown, the $M_{23}C_6$ phase is completely dissolved above 800° C. Sufficiently rapid cooling may suppress the formation of this undesirable carbide during the manufacturing process.

Figure 3A:
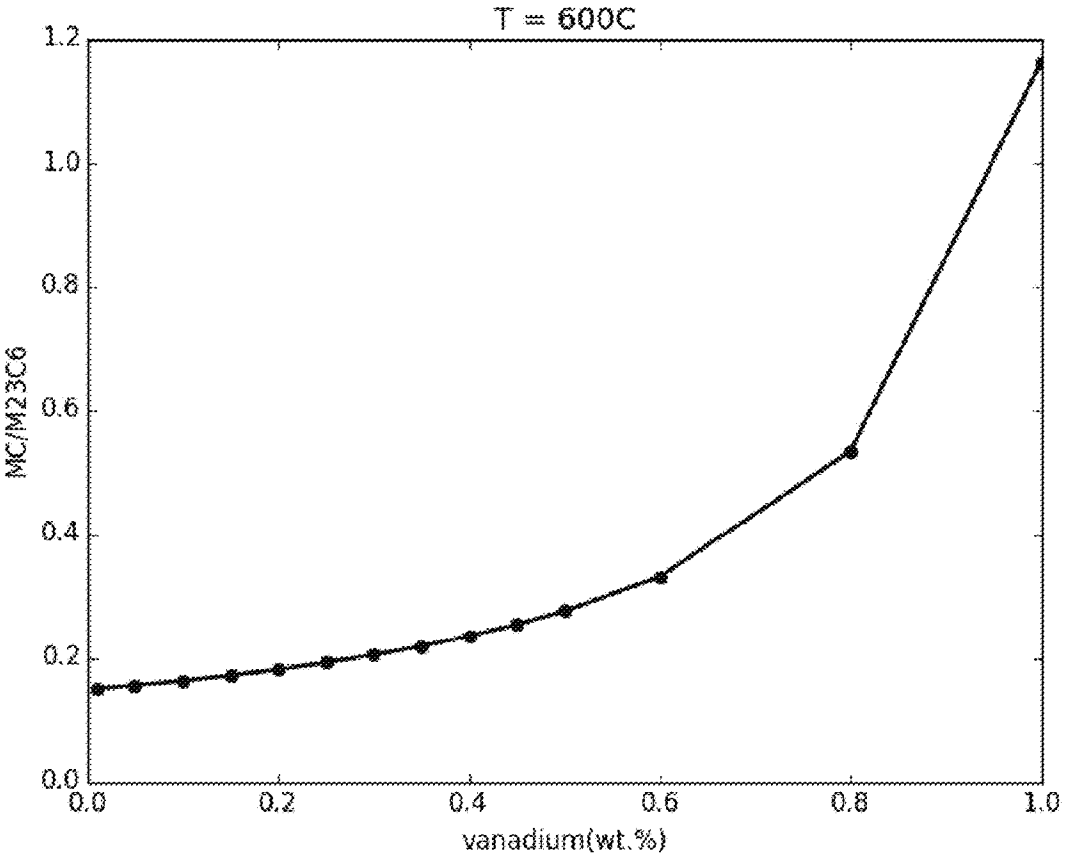
FIG. 3A plots the calculated ratio of MC phase to $M_{23}C_6$ phase at 600° C. versus V concentration for the low-carbon steel composition of FIG. 2A containing 0.029 wt. % C, 10 wt. % Cr, 1.09 wt. % Mn, 0.12 wt. % Mo, 0.06 wt. % Nb and 0.21 wt. % Si.
Figure 3B:
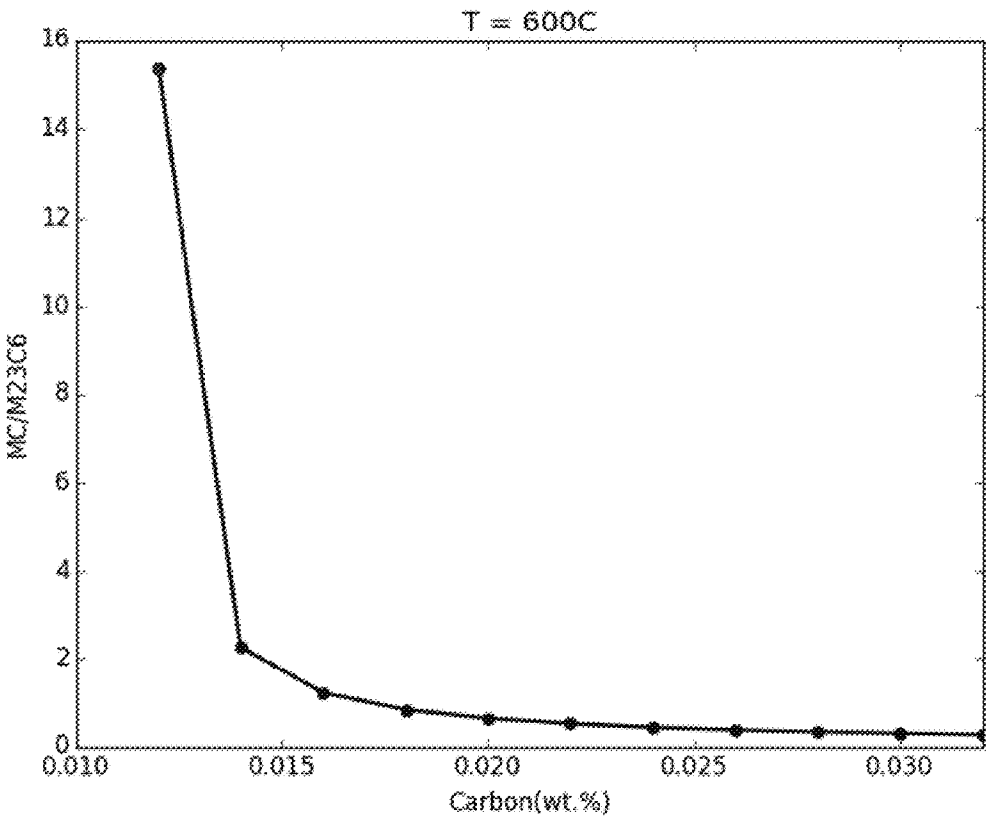
FIG. 3B plots the calculated ratio of MC phase to $M_{23}C_6$ phase at 600° C. versus C concentration for the low-carbon steel composition of FIG. 2A, containing 10 wt. % Cr, 1.09 wt. % Mn, 0.12 wt. % Mo, 0.3 wt. % V, 0.06 wt. % Nb and 0.21 wt. % Si.
Figure 3C:
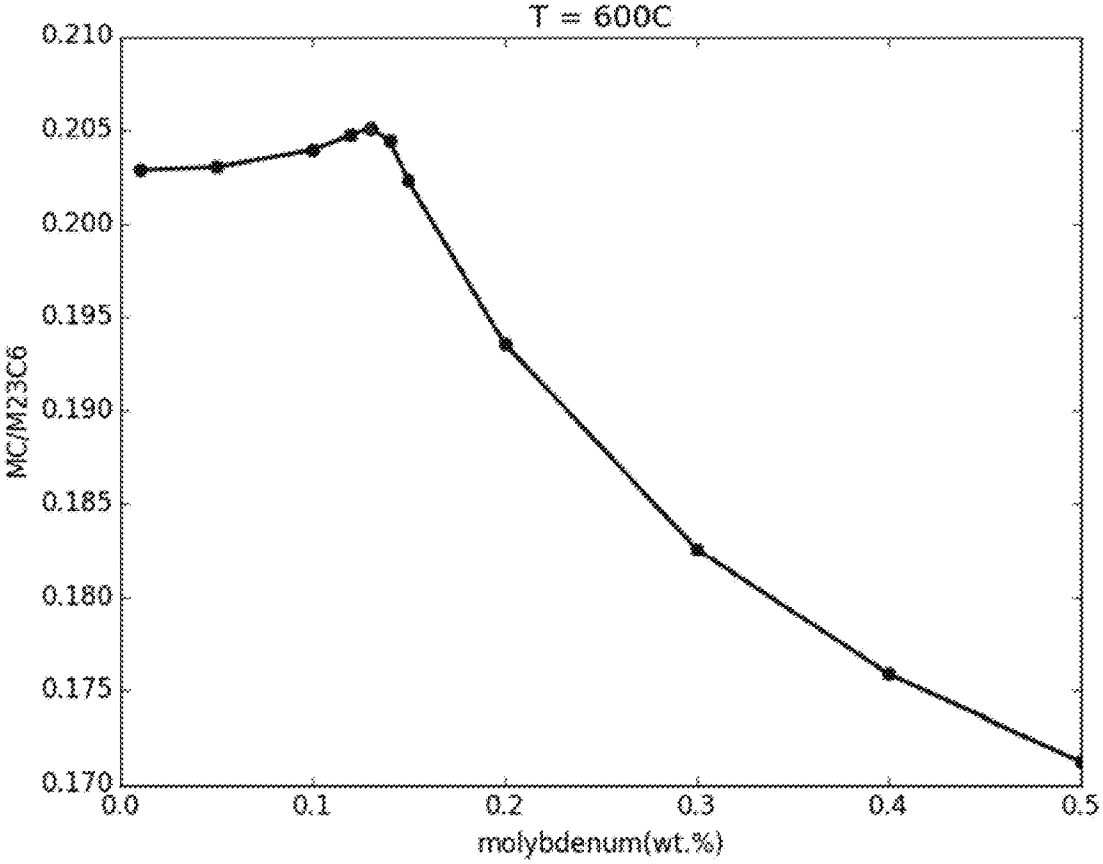
FIG. 3C plots the calculated ratio of MC phase to $M_{23}C_6$ phase at 600° C. versus Mo concentration for the low-carbon steel composition of FIG. 2A containing 0.029 wt. % C, 10 wt. % Cr, 1.09 wt. % Mn, 0.3 wt. % V, 0.06 wt. % Nb and 0.21 wt. % Si.

FIGS. 3A-3C plot the calculated ratio of MC phase to $M_{23}C_6$ phase versus V concentration (FIG. 3A), C concentration (FIG. 3B), and Mo concentration (FIG. 3C) at a temperature of 600° C.

Experimental Methods

Three steel compositions were formed and tested, 0Cr-0.19V, 10Cr-0.3V, and 10Cr-0.9V. The compositions are shown in Tables 1A-1C, below.

TABLE 1A

| Steel Composition 0Cr—0.19V. | | | | | | | |
|---|---|---|---|---|---|---|---|
| | Element | | | | | | |
| | C | Cr | Mn | Mo | V | Nb | Si |
| wt. % | 0.029 | 0 | 1.09 | 0.12 | 0.19 | 0.06 | 0.21 |

TABLE 1B

| Steel Composition 10Cr—0.3V. | | | | | | | |
|---|---|---|---|---|---|---|---|
| | Element | | | | | | |
| | C | Cr | Mn | Mo | V | Nb | Si |
| wt. % | 0.029 | 10.0 | 1.09 | 0.12 | 0.3 | 0.06 | 0.21 |

TABLE 1C

| Steel Composition 10Cr—0.9V. | | | | | | | |
|---|---|---|---|---|---|---|---|
| | Element | | | | | | |
| | C | Cr | Mn | Mo | V | Nb | Si |
| wt. % | 0.029 | 10.0 | 1.09 | 0.12 | 0.9 | 0.06 | 0.21 |

Fabrication of the experimental steels was done through vacuum arc melting of 11 g ingots with the desired composition. Each ingot was inverted 4 times during melting to ensure homogeneity throughout the sample. All samples were normalized for 1 h at 975° C. after arc melting and then air-cooled. No other thermomechanical processing steps were used. Microstructures of selected samples were observed using an optical microscope before and after aging treatment at elevated temperatures. Samples were ground flat using carbide grinding paper, and final polishing was done with 1 μm diamond suspension. Samples were then etched using a 2% nital solution to reveal grain boundaries.

Mechanical properties were evaluated using Vickers indentation at 700° C. in partial vacuum (pressure <20 Pa).

The applied load was 1 kgf. Samples were ground flat and polished with 1 μm diamond suspension prior to hardness testing. Samples were also soaked at 700° C. for 30 minutes prior to indentation to ensure thermal uniformity.

The samples were tested for hardness at room temperature to establish base hardness levels. Aging times at 700° C. were 2, 10, 27, 100, and 1000 hours.

Atom probe tomography (APT) was used to study the formation and evolution of precipitate size and composition during aging at elevated temperatures. Samples were machined into 300 μm×300 μm×12.7 mm rectangular blanks. The blanks were then electropolished to a sharp tip using two different electrolytes: 5% perchloric acid in acetic acid for neck formation and 2% perchloric acid in butoxyethanol for final polishing. Atom evaporation was conducted using voltage ramped from 0 V to approximately 7 kV, and evaporation was assisted by 20 pJ UV laser pulses at 500 kHz. The voltage was controlled to maintain a constant evaporation rate. Data analysis was conducted using the Integrated Visualization and Analysis Software (IVAS) software suite developed by CAMECA (D. J. Larson, T. J. Prosa, R. M. Ulfig, B. P. Geiser, T. F. Kelly, Local Electrode Atom Probe Tomography: A User's Guide, Springer, New York, 2013).

Results and Discussion

As shown in Tables 1A-1C, each of the three steels had approximately the same C, Mo, Nb, Mn, and Si content. 0Cr-0.19V is the reference alloy without Cr. 10Cr-0.3V has sufficient Cr to make it corrosion-resistant in steam environments; the additional V promotes the formation of a larger phase fraction of MC. 10Cr-0.9V has an even higher fraction of MC, and most importantly is calculated to have no $M_{23}C_6$ phase at 700° C., as shown in FIG. 2B.

Optical micrographs of 0Cr-0.19V before (a) and after (b) aging treatment at 600° C. for 8 h were obtained (data not shown). The microstructure of these samples was characteristic of ferrite (bcc Fe) with small amounts of pearlite and bainite. After aging, only the ferrite phase remains. This is consistent with the computational thermodynamics modeling described above that showed (ferrite+MC+$M_{23}C_6$) as the stable phases at 600° C. for this alloy composition.

Figure 4A:
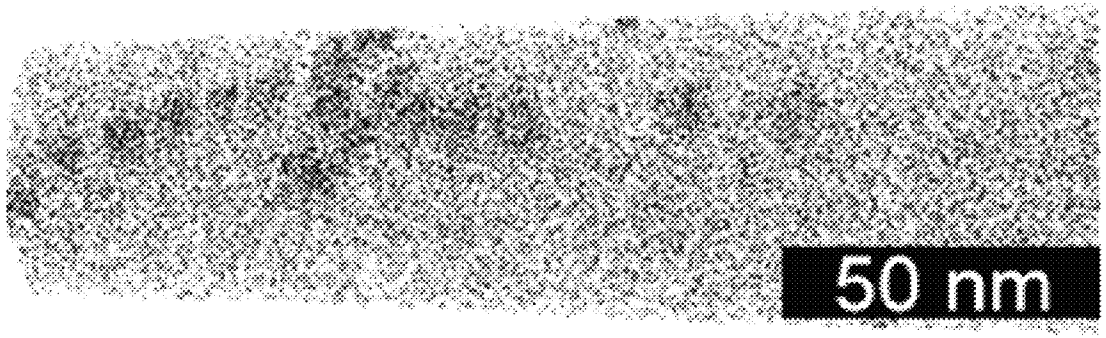
FIG. 4A shows an atom probe tomography (APT) reconstruction of a 0 Cr-0.19V steel composition after aging at 600° C. for 27 h. Nanosized carbide precipitates are observed (the larger, darker clusters).
Figure 4B:
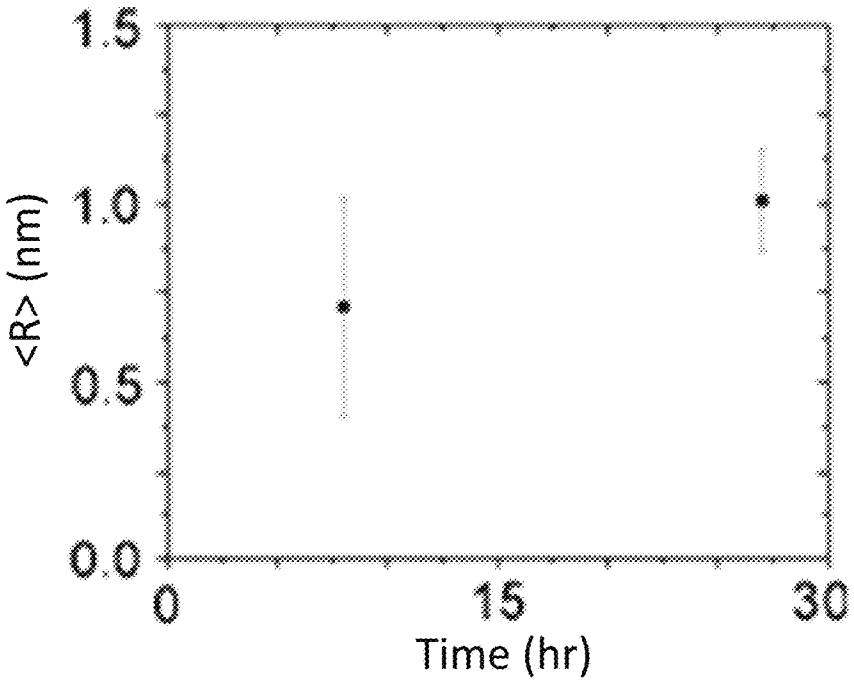
FIG. 4B shows the average precipitate radius versus aging time at 600° C.
Figure 4C:
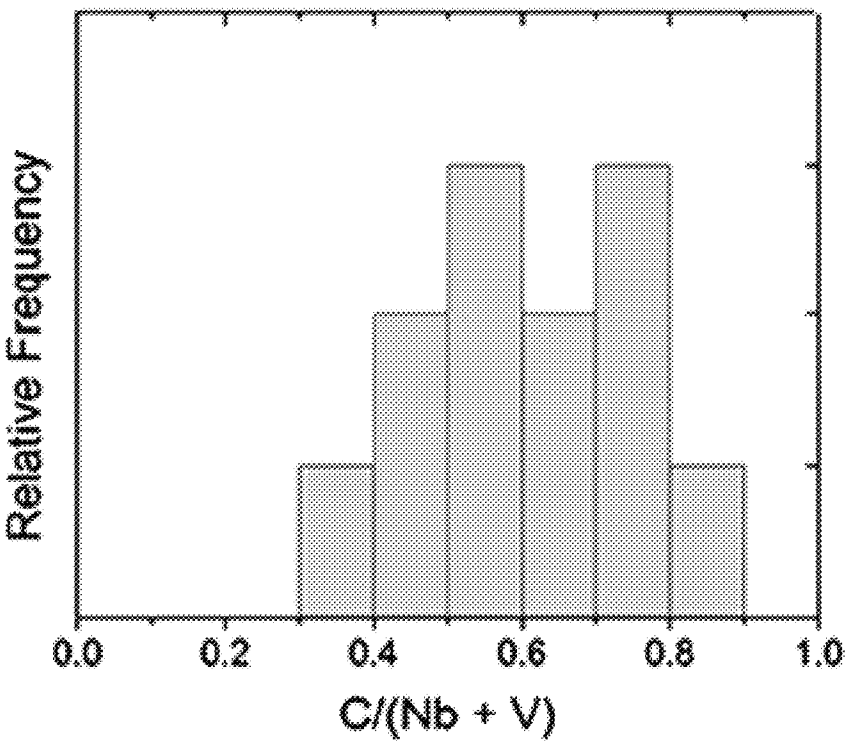
FIG. 4C shows a histogram of C/(Nb+V) ratios of the precipitates after 27 h of aging at 600° C.

FIG. 4A shows an APT reconstruction of 0Cr-0.19V after aging at 600° C. for 27 h, showing the presence of nanosized (Nb,V)C precipitates (larger darker clusters). FIG. 4B shows the growth of these precipitates as a function of time at 600° C. Even after 27 h, the average radius of these precipitates was only about one nm. This result demonstrates the thermal stability of the precipitates. FIG. 4C shows statistical distribution of C/(Nb+V) ratio for precipitates. From this plot, it can be inferred that the precipitates are most likely a combination of the stable MC precipitates (ratio near 0.8), and metastable $M_2C$ precipitates (ratio near 0.5).

The Vickers hardness (HV) of 0Cr-0.19V steel was measured as a function of aging at 600° C. (data not shown). There was an initial increase in hardness from 20 min to 8 h, reaching a peak value of 105, due to the nucleation of precipitates. From 8 to 100 h, there was a slight decrease of Vickers hardness, due to the slow growth and coarsening of these precipitates. The peak hardness of 105 corresponds to tensile strength of 343 MPa.

Figure 5A:
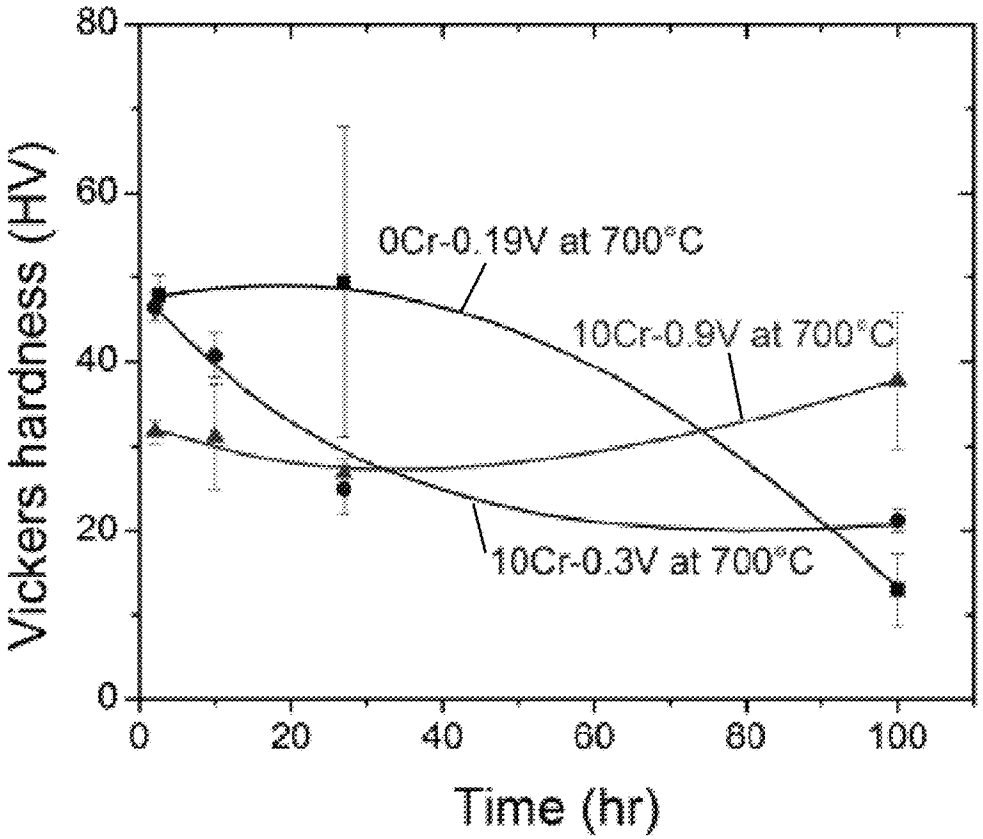
FIG. 5A shows the Vickers hardness for 0Cr-0.19V, 10Cr-0.3V, and 10Cr-0.9V steel compositions between 2 and 100 h at 700° C. The lines serve as guides for the eye.
Figure 5B:
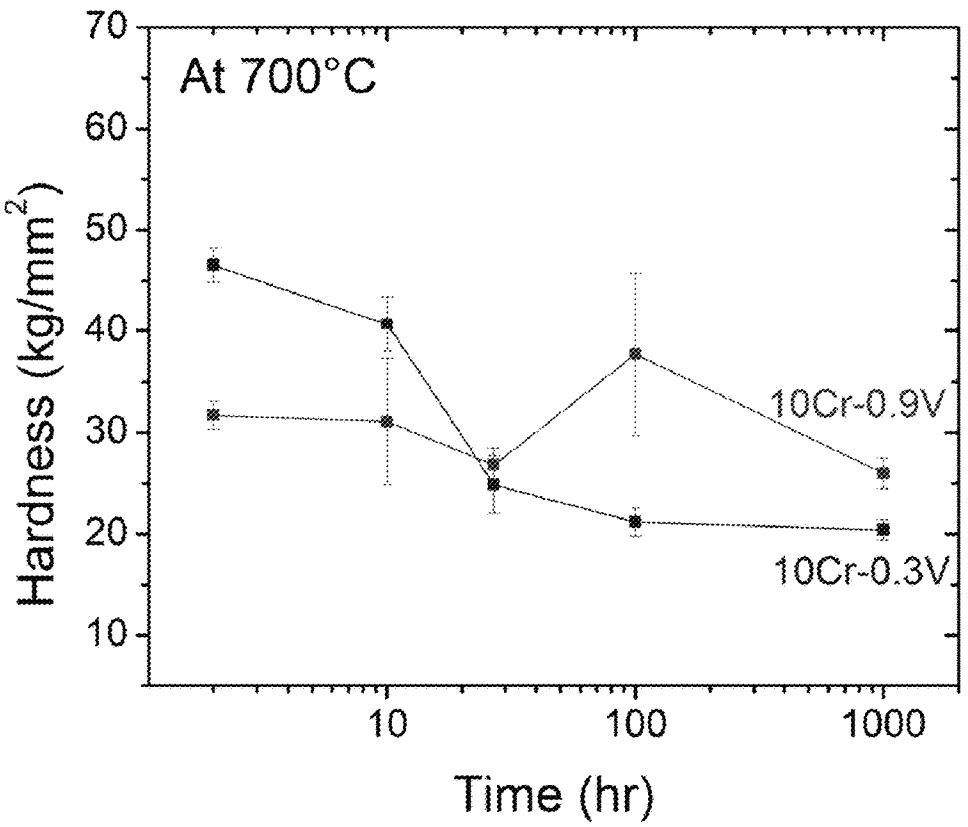
FIG. 5B shows the Vickers hardness for 10Cr-0.3V and 10Cr-0.9V steel compositions between 2 and 1000 h at 700° C. The lines serve as guides for the eye.

FIG. 5A shows the Vickers hardness (measured at 700° C.) for all three of the experimental steels versus aging time at 700° C. For 0Cr-0.19V steel its Vickers hardness is maintained up to 27 h, beyond which the hardness decreases. In contrast, the hardness of 10Cr-0.3V steel decreases slowly between 27 and 100 h. An interesting observation is that the hardness of 10Cr-0.9V steel continues to increase at 100 h, achieving Vickers hardness of 38, or tensile strength of 124 MPa. Without wishing to be bound to any particular theory, it is believed this transient is a consequence of the slower diffusion of alloying elements in the high V sample. The initial slight decrease in hardness may be a combination of dislocation recovery, grain boundary and perhaps conversion of martensite to ferrite. As the steel continues to age, MC precipitates start to form, providing secondary strengthening. All these results are consistent with the fact that higher V promotes the formation of MC precipitates that are thermally stable and maintain strength at elevated temperatures. The observed trend suggests strength retention for longer times, which in turn suggests slower coarsening of these precipitates. FIG. 5B shows the Vickers hardness (measured at 700° C.) for 10Cr-0.3V steel and 10Cr-0.9V steel up to 1000 h.

Steels for steam generators in power plants are supposed to maintain ≥35 MPa strength (Vickers hardness 12 $kg/mm^2 \approx 10$ HV) for at least 100,000 h. The performance of the two Cr-based experimental steels was evaluated relative to this requirement. For 10Cr-0.3V, the hardness decreased at the rate of 0.8 per hour between 0.3 and 27 h at 700° C., and 0.034 per hour between 27 and 100 h. If it is assumed that this rate further decreases to 0.01 per hour beyond 100 h, the hardness of 10Cr-0.3V will decrease to 10 at 1250 h. The coarsening of these MC precipitates is controlled by diffusion. In bcc iron, the diffusion of carbon is rapid so that the coarsening of MC precipitates is controlled by the diffusion of the other two alloying elements, Nb and V. The Nb diffusivity is given by $D=1.7\times10^{-3}\exp(-252000/RT)$ $m^2s^{-1}$ (T. Gladmann, The Physical Metallurgy of Microalloyed Steels, Institute of Materials, London, 1997), and that for V is given by $D=1.17\times10^{-4}\exp(-228040/RT)$ $m^2s^{-1}$ (V. V. Popov, Defect. Diffus. Forum 283-286 (2009) 687). The ratio of diffusivity at 700 to 600° C. can be shown to be 35 for Nb and 25 for V. Therefore, the extrapolated lifetime of 10Cr-0.3V at 600° C. is between 31,000 and 44,000 h. Repeating this calculation for 10Cr-0.9V gives the extrapolated lifetime at 600° C. to be between 73,000 and 102,000 h.

The proposed operating temperature of the steels is between 600° C. and 625° C. Using the acceleration factor of 35 (based on the slower diffusing Nb as described above), the extrapolated hardness value of 10Cr-0.3V after exposure to 600° C. for 100,000 hours is 18.8 $kg/mm^2$ and the extrapolated hardness value of 10Cr-0.9V after exposure to 600° C. for 100,000 hours is 24.4 $kg/mm^2$, both which are well above the goal of 12 $kg/mm^2$.

Conclusion

A combined surface science and computational thermodynamics approach in the design and development of Cr-based steels that produce thermally stable transition metal monocarbide (MC) precipitates at elevated temperatures. The design was based on the surface/interface science principle that semi-coherent MC precipitates consisting of slow diffusing elements tend to coarsen slowly and that such a semi-coherent precipitate-matrix interface exerts a drag force on impinging dislocations. Combined with computational thermodynamics, two Cr-based steel compositions were designed which maximize the volume fraction of such MC precipitates. These Cr-based steels were shown to maintain good strength for extended 700° C. exposures and are thus suitable materials for use in steam generators in power plants for higher thermal efficiencies.

Example 2

In this Example, Zr was added into the steel compositions of Example 1 as another MC forming element with large negative enthalpy of MC formation, slow diffusion, and relatively low cost. The concentration of Zr as well as V was adjusted to provide high mole fraction of MC precipitates with minimal or no other detrimental phases ($M_{23}C_6$, FeZr intermetallics, etc.) at high temperatures. Without wishing to be bound to any particular theory, due to the difference in diffusivity, enthalpy of MC formation, and interfacial energy between MC (M=Mo, Nb, V, and Zr) and the bcc Fe matrix, the MC precipitate of the steels in this Example may exhibit a core-shell precipitate structure, e.g., VC on the outside and ZrC on the inside of the precipitate to minimize interfacial energy. The formation of such a core-shell precipitate structure requires Zr to diffuse through the VC outer shell, thus slowing down the coarsening of MC precipitates and hence leading to better performance at high temperatures.

Figure 6A:
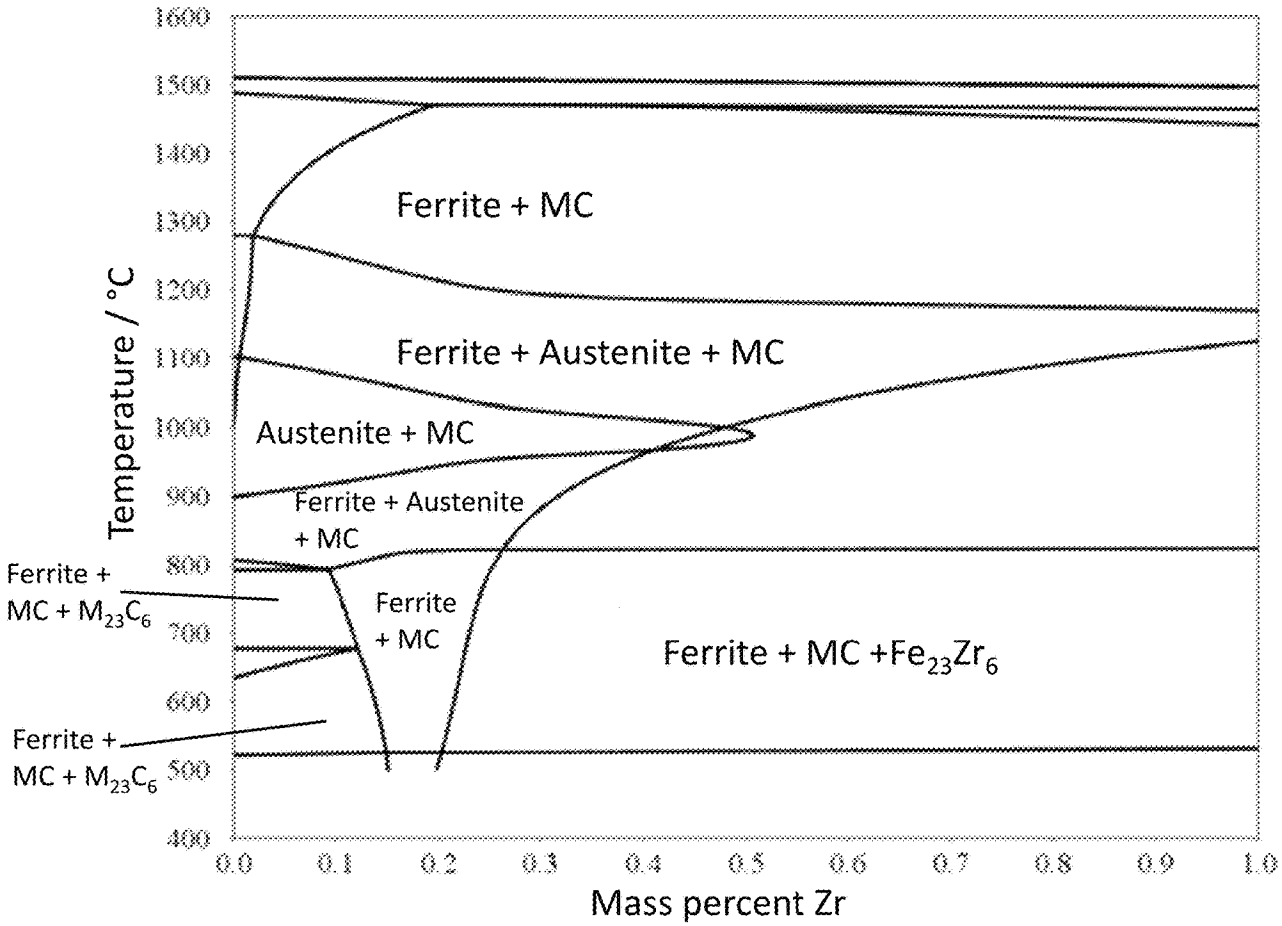
FIG. 6A plots the calculated zirconium (Zr) isopleths of a low-carbon steel composition containing 10 wt. % Cr, 0.3 wt. % V, and variable amounts of Zr.
Figure 6B:
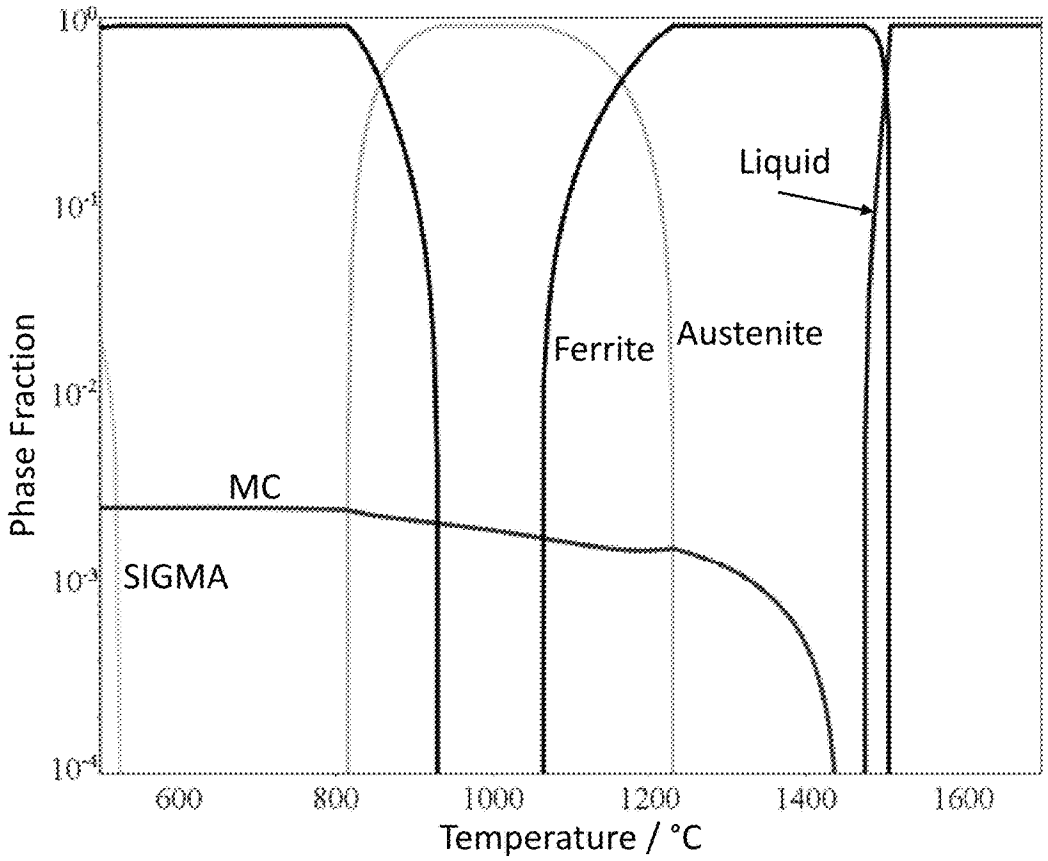
FIG. 6B plots the phase mole fraction of a 10Cr-0.3V-0.2Zr steel composition as a function of temperature. Sigma is an intermetallic phase.

Computational thermodynamics was performed as described in Example 1, above. FIG. 6A shows a zirconium isopleth for a steel composition containing 10Cr-xZr (in wt. %). FIG. 6B shows the phase mole fractions as a function of temperature. Desirable compositions have a maximum mole fraction of MC precipitates without other detrimental phases at elevated temperature.

Figure 7:
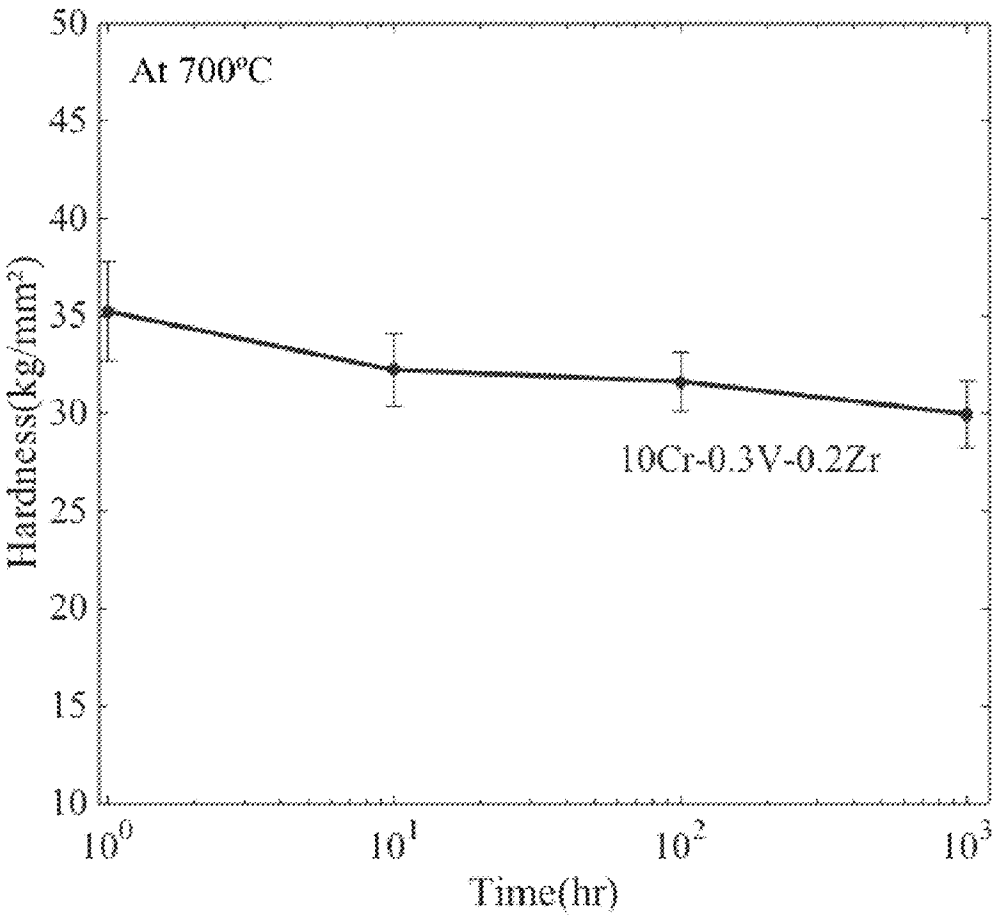
FIG. 7 shows the Vickers hardness for 10Cr-0.3V-0.2Zr steel composition between 1 and 1000 h at 700° C. The lines serve as guides for the eye.

Steel having the composition shown in Table 2, below, was formed and evaluated similar to the techniques described in Example 1, above. Briefly, the steel was fabricated by arc melting with a mass of roughly 170 grams. The alloy was normalized at 1000° C. for 2 hour followed by water quenching to room temperature. No other thermo-mechanical processing steps were used. Aging times at 700° C. were 1, 10, 100, and 1000 hours. After each stage of aging, the samples were polished and high temperature Vickers indentation was performed. High temperature tests were performed by soaking the samples at 700° C. for 30 minutes prior to indentation to ensure temperature uniformity. Indentation was carried out at a load of 1 kgf at 700° C. under partial vacuum (<20 Pa). The results are shown in FIG. 7. This figure shows that the hardness of 10Cr-0.3V-0.2Zr decreases very slowly by about 2 kg/mm$^2$ for each decade increase in exposure time to 700° C. Extrapolation gives a hardness value of 26 kg/mm$^2$ after exposure to 700° C. for 100,000 hours. Thus, this material is suitable for use in steam generators in power plants for higher thermal efficiencies.

TABLE 2

Steel Composition 10Cr—0.3V—0.2Zr.

| | Element | | | | | | | |
|---|---|---|---|---|---|---|---|---|
| | C | Cr | Mn | Mo | V | Nb | Si | Zr |
| wt. % | 0.029 | 10.0 | 1.08 | 0.12 | 0.3 | 0.06 | 0.21 | 0.2 |

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more".

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A steel composition comprising
iron;
from 0.026 to 0.032 wt. % carbon;
from 9 to 12 wt. % chromium;
from 0.98 to 1.20 wt. % manganese;
from 0.11 to 0.13 wt. % molybdenum;
from 0.19 to 0.23 wt. % silicon;
from 0.2 to 1.0 wt. % vanadium;
from 0.05 to 0.07 wt. % niobium; and
optionally, an amount of an additional precipitate forming alloying element, wherein the steel composition is free of nitrogen, calcium and magnesium.

2. The steel composition of claim 1, wherein the steel composition consists essentially of the iron, the carbon, the chromium, the manganese, the molybdenum, the silicon, the vanadium, and the niobium with the proviso that the steel composition is free of the nitrogen, the calcium, and the magnesium.

3. The steel composition of claim 1, wherein the additional precipitate forming alloying element is present and is selected to provide core-shell precipitates in the steel composition comprising a core comprising a first monocarbide $M_aC$ and a shell comprising a second monocarbide $M_bC$, wherein $M_a$ is the additional precipitate forming alloying element and $M_b$ is vanadium, niobium, or molybdenum.

4. The steel composition of claim 3, wherein the additional precipitate forming alloying element is zirconium or hafnium.

5. The steel composition of claim 4, wherein the additional precipitate forming alloying element is zirconium which is present in an amount of at least 0.06 wt. %.

6. The steel composition of claim 4, wherein the additional precipitate forming alloying element is zirconium which is present in an amount of from 0.06 to 0.3 wt. %.

7. The steel composition of claim 4, wherein the additional precipitate forming alloying element is hafnium which is present in an amount of from 0.12 to 0.40 wt. %.

8. The steel composition of claim 1, wherein the steel composition consists essentially of the iron, the carbon, the chromium, the manganese, the molybdenum, the silicon, the vanadium, the niobium, and the additional precipitate forming alloying element with the proviso that the steel composition is free of the nitrogen, the calcium, and the magnesium.

9. The steel composition of claim 1, wherein the additional precipitate forming alloying element is zirconium and the zirconium is present in an amount of at least 0.06 wt. %.

10. The steel composition of claim 1, wherein the additional precipitate forming alloying element is zirconium and the zirconium is present in an amount of from 0.06 to 0.3 wt. %.

11. The steel composition of claim 1, wherein
vanadium is present in an amount of from 0.2 to 0.4 wt. %;
and
zirconium is present in an amount of from 0.15 to 0.27 wt. %.

12. The steel composition of claim 1, wherein
vanadium is present in an amount of from 0.2 to 0.4 wt. %;

zirconium is present in an amount of from 0.17 to 0.25 wt. %.

13. The steel composition of claim 1, wherein vanadium is present in an amount of from 0.2 to 0.4 wt. %;

and zirconium is present in an amount of from 0.19 to 0.23 wt. %.

14. The steel composition of claim 1, wherein the steel composition is characterized by a Vickers Hardness at about 700° C. of at least about 20 $kg/mm^2$ as measured after exposing the steel composition to a temperature of about 700° C. for about 1000 h.

15. A method of making a steel composition comprising forming an ingot comprising iron, from 0.026 to 0.032 wt. % carbon, from 9 to 12 wt. % chromium, from 0.98 to 1.20 wt. % manganese, from 0.11 to 0.13 wt. % molybdenum, from 0.19 to 0.23 wt. % silicon, from 0.2 to 1.0 wt. % vanadium, from 0.05 to 0.07 wt. % niobium, and optionally, an amount of an additional precipitate forming alloying element, wherein the ingot is free of nitrogen, calcium and magnesium;

normalizing the ingot; and cooling the normalized ingot.

16. The method of claim 15, wherein the method does not comprise subjecting the ingot to any additional thermomechanical processing steps.

17. The method of claim 15, wherein the normalizing is conducted at a temperature in the range of from about 950° C. to about 1100° C.

* * * * *